US006834630B1

(12) United States Patent
Mueller et al.

(10) Patent No.: US 6,834,630 B1
(45) Date of Patent: Dec. 28, 2004

(54) STARTING SYSTEM FOR AN INTERNAL COMBUSTION ENGINE

(75) Inventors: Karsten Mueller, Hannover (DE); Manfred Klaue, Schellerten (DE); Orf Schneider, Hildesheim (DE); Stefan Ossenkopp, Hildesheim (DE); Siegbert Wessels, Hildesheim (DE); Harald Buehren, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 309 days.

(21) Appl. No.: 09/889,064

(22) PCT Filed: Nov. 10, 2000

(86) PCT No.: PCT/DE00/04009

§ 371 (c)(1),
(2), (4) Date: Feb. 6, 2002

(87) PCT Pub. No.: WO01/36815

PCT Pub. Date: May 25, 2001

(30) Foreign Application Priority Data

Nov. 15, 1999 (DE) ..... 199 55 061

(51) Int. Cl.[7] ..... F02N 15/02

(52) U.S. Cl. ..... 123/179.25; 74/6; 74/7 E; 290/48

(58) Field of Search ..... 123/179.25; 74/6–9; 290/48, 38 R–38 E

(56) References Cited

U.S. PATENT DOCUMENTS

| | | | | |
|---|---|---|---|---|
| 4,362,065 A | 12/1982 | Baratti | ..... | 74/7 A |
| 4,945,777 A | 8/1990 | Isozumi | | |
| 5,163,335 A | 11/1992 | Isom | ..... | 74/6 |
| 5,720,247 A | 2/1998 | Suzuki | ..... | 123/179.25 |

FOREIGN PATENT DOCUMENTS

DE 39 28 407 C2 1/1994

*Primary Examiner*—Ramon M. Barrera
(74) *Attorney, Agent, or Firm*—Michael J. Striker

(57) ABSTRACT

The invention relates to a starter system for an internal combustion engine, in particular in motor vehicles, having a starter motor, a reduction gear, and a pinion-engaging assembly.

The primary components of the starter system (10) are embodied as individual modules and can be expanded in variable ways to make starter systems (10) with different parameters.

6 Claims, 2 Drawing Sheets

STARTING SYSTEM FOR AN INTERNAL COMBUSTION ENGINE

BACKGROUND OF THE INVENTION

The invention relates to a starter system for an internal combustion engine, in particular, for motor vehicles.

It is known that internal combustion engines have to be cranked until they reach the point where they run on their own. To that end, so-called starter systems are used in motor vehicles. These starter systems include a starter motor, supplied by a motor vehicle battery, a reduction gear, and a pinion-engaging assembly. For starting the engine, the starter motor is connected to the motor vehicle battery via a starter switch (ignition switch). Once the starter motor is put in operation, a pinion is made to engage a ring gear disposed on a crankshaft of the engine, so that the engine can be cranked. Since the starter motors have a substantially higher rpm than what is required to crank the engine, these different rotary speeds are adapted via a reduction gear. The reduction gear is typically embodied as a planetary gear, with the sun wheel drivable by the starter motor and the crankshaft operatively connected to the planet wheels.

A crankshaft torque required to crank the engine and a minimum crankshaft rpm depend on engine parameters, such as stroke volume, number of cylinders, compression, friction losses, temperature, and additional loads. Thus a starter system has to be adapted to the parameters of the engine. In particular, there is a need for starter systems with different starting power levels and/or different starting rotary speeds.

In the known starter systems, it is disadvantageous that for the sake of high utilization of installation space, they are embodied in a so-called inter-nested way, and that to adapt the starter power and/or the starting rotary speed of the starter, many different-sized starter systems are needed. Adapting to altered parameters of an engine can be done only by redimensioning or reconstructing the entire starter system.

SUMMARY OF THE INVENTION

The starter system of the invention offers the advantage over the prior art that adaptation to engines of different parameters can be done in a simple way. Because the primary components of the starter system are embodied as individual modules and can be expanded variably into starter systems with different parameters, it is simple, beginning with the individual modules, to achieve different starter systems without having to reconstruct the entire starter system.

In a preferred feature of the invention, it is provided that the starter system includes a drive module, a gear module and an electronic module. This makes it possible for the primary components of the starter system to be optimized individually to desired starting parameters, so that the desired starter system with the requisite parameters can be assembled from the existing variously-sized individual modules. It is also preferable for a drive module to be combinable with different gear modules, so that adapting the starter system to a desired crankshaft rpm can be done solely via the gear modules. Thus the same type of drive modules can be combined with the appropriate gear modules. On the other hand, it is equally possible for different crankshaft torques to be attained via drive modules with different power level parameters but the same gear modules.

Overall, it becomes clear that by the modular design of the starter system provided for by the invention, identical component groups can be used for different starter system power level classes. By taking standard sizes into account in the individual component groups, these groups can be accordingly assembled in final form economically, thus reducing both the effort and cost of production. In particular, this also makes for high flexibility in final assembly of the starter system, especially when making a rapid adaptation to altered application requirements of different internal combustion engines.

BRIEF DESCRIPTION OF THE DRAWINGS

The invention is described in further detail below in terms of exemplary embodiments in conjunction with the associated drawings. Shown are.

DETAILED DESCRIPTION OF THE PREFERRED EMBODIMENTS

Figure 1:
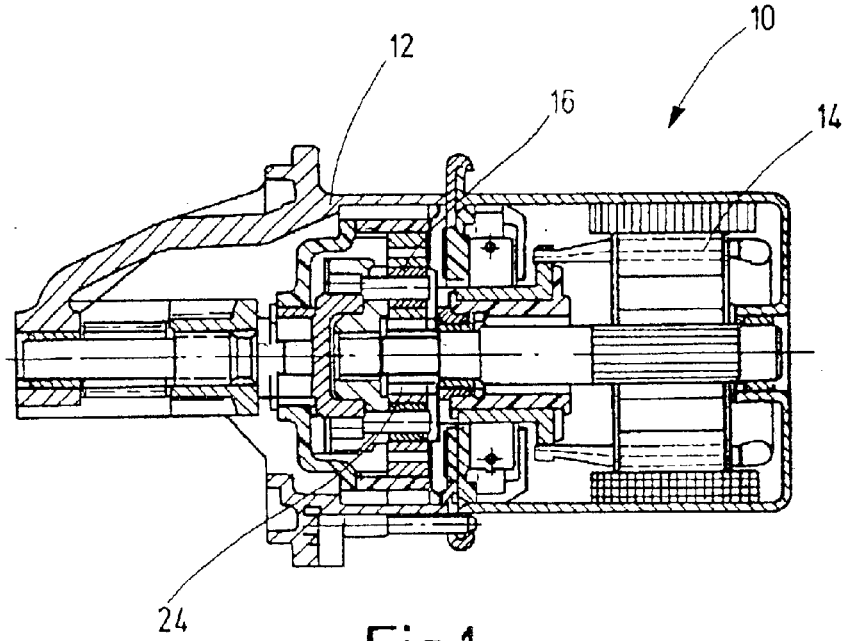
FIG. 1, a sectional view through a starter system of the invention in a first exemplary embodiment.

FIG. 1 shows a starter system, identified overall by reference numeral 10, for an internal combustion engine, not shown. Inside a housing 12, the starter system 10 includes a starter motor 14 and a reduction gear 16 embodied as a planetary gear. The structure and function of such starter systems 10 are known, so that these will not be addressed further in the present description.

Figure 2:
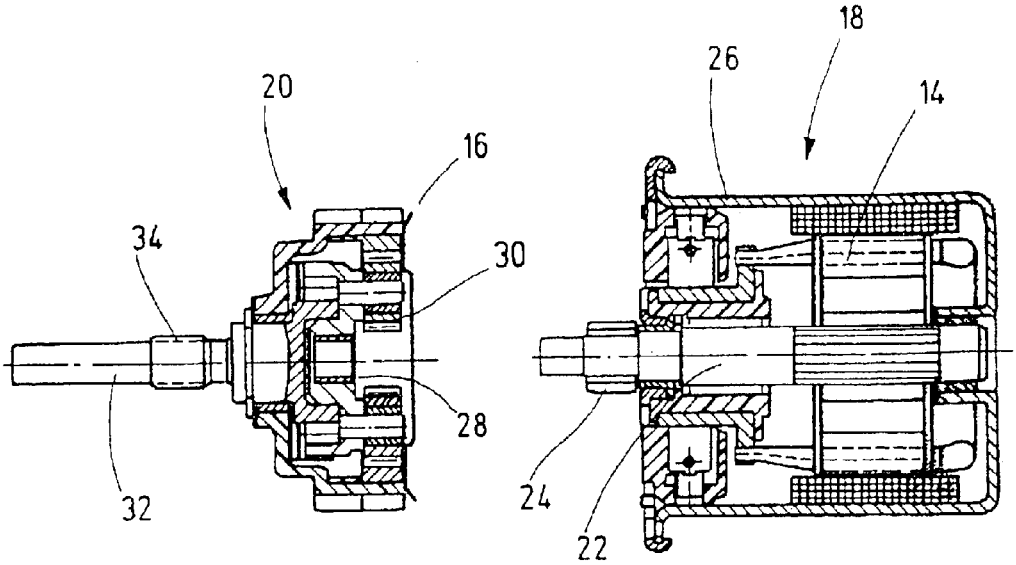
FIG. 2, primary component groups of the starter system of FIG. 1.

In FIG. 2, sectional views of the two primary groups of the starter system are shown, in the state before final assembly. The drive motor 14 forms a drive module 18, and the reduction gear 16 forms a gear module 20. The starter motor 14 is a direct current motor, whose structure and function are likewise well known. An armature shaft 22 of the starter motor 14 has a pinion 24, which is disposed on the armature shaft 22 in a manner fixed against relative rotation. The armature shaft 22 is extended past the housing 26 of the starter motor 14 and can be introduced into a guide 28 of the reduction gear 16. When the drive module 18 is mounted to the gear module 20, the armature shaft 22 engages the guide 28, so that the slip-on pinion 24 meshes planet wheels 30 of the reduction gear 16. The slip-on pinion 24 thus forms the sun wheel of the reduction gear (planetary gear) 16. An output shaft 32 of the gear module 20 has a pinion 34, which in a manner known per se can be made to engage a ring gear disposed on a crankshaft of the engine.

Depending on a demand for rotary speed and/or torque for starting (cranking) the engine, the starter system 10 can be dimensioned accordingly by a suitable choice of the drive module 18 and/or gear module 20. The torque can be achieved by choosing a power level of the starter motor, which can range between 0.7 kW and 2.3 kW, for instance. The adaptation to a required rotary speed can be done by means of a gear ratio of the reduction gear 20, and by the choice of a suitable slip-on pinion 24, the gear ratio can be varied, with otherwise the same drive module 18 and gear module 20. It becomes clear that at little effort or expense, starter systems 10 for different requirements can thus be furnished in a simple way, for instance with regard to a crankshaft torque and/or a crankshaft rpm. The various basic components of the starter system 10 can be made economically by mass production, since a specific adaptation is possible either by selecting the drive module 18 and/or selecting the slip-on pinion 24 and/or the gear module 20.

A free-wheel mechanism of the starter system 10 is integrated with the reduction gear 20. This free-wheel mechanism disconnects the starter motor 14 from the crankshaft of the internal combustion engine once this engine is at a minimum rpm. This averts the possibility of damage to the drive motor 14 when the armature rpm is exceeded by the crankshaft rpm.

Figure 3:
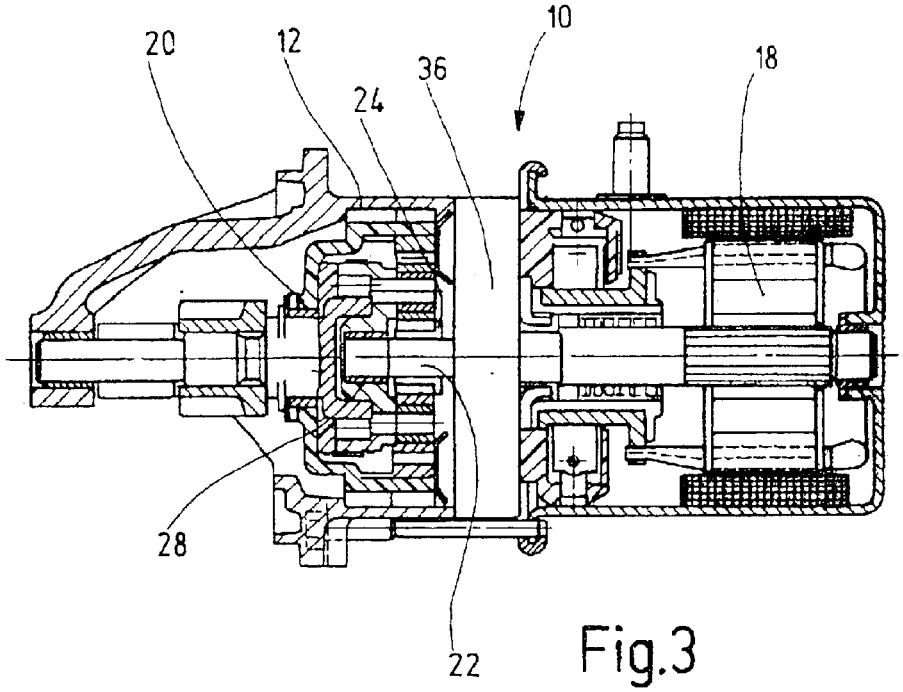
FIG. 3, a sectional view through a starter system in a second exemplary embodiment.

FIG. 3 shows a modified starter system 10, in which in addition to the drive module 18 and the gear module 20, an electronic module 36 is integrated. The electronic module 36 takes on control functions for the starter system 10, such as a start/stop function, current clocking and/or an immobilizer function. Such functions are likewise known. Of interest to the present invention is the fact that the electronic module 36 is integrated as a compact module into the housing 12 of the starter system 10. The electronic module 36 can for instance be flanged to the drive module 18. To span the axial length of the electronic module 36, the armature shaft 22 is embodied as correspondingly longer, so that it can engage the guide portion 28 of the gear module 20. It is quite clear from FIG. 3 that by replacing the electronic module 36, different functions of the starter system 10 can easily be incorporated into the starter system 10 as desired by the user. The other components, the drive module 18 and the gear module 20, remain untouched by such an adaptation.

Overall, it can be stated that each of the individual modules, that is, the drive module 18, the electronic module 36 and/or the gear module 20, can be optimized on its own. These modules are standardized in the sense that in the final assembly of starter systems 10, various drive modules 18, electronic modules 36 and gear modules 20 that are in stock can be combined selectively with one another. The sole decisive factor is what the user of the starter system 10 requires.

Figure 4:
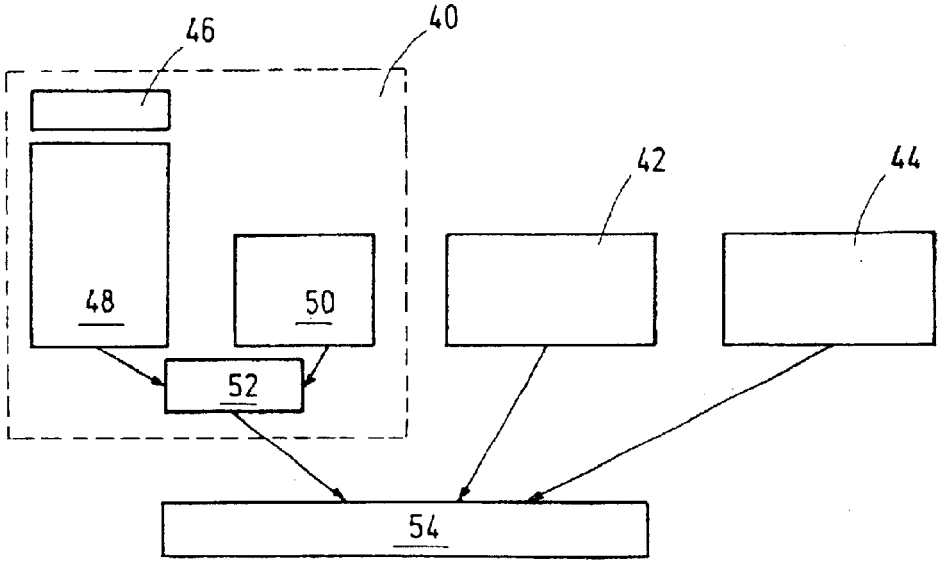
FIG. 4, a block diagram illustrating the production of the starter systems of the invention.

FIG. 4, in a block circuit diagram, illustrates the final assembly of starter systems 10 from different modules. Block 40 indicates the production of the drive modules 18, block 42 the production of the gear modules 20, and block 44 the production of the electronic modules 36. For producing the drive modules 18, it is shown in suggested form inside the complex 40 for instance that the armature shaft is furnished in a step 46, the armature assembly is done in a step 48, the pole housing assembly is done in a step 50, and finally the assembly of the drive module 18 is done in a step 52.

Depending on the application demand made of the starter system 10, the appropriate drive module 18, the appropriate gear module 20 and the appropriate electronic module 36 are then completed in a final step 54 to make the desired starter system 10. By means of the modular construction explained, in which the individual modules are compatible with one another even given different power level parameters and speed-increase parameters, the production of starter systems 10 can be simplified considerably and thus made more economical.

What is claimed is:

1. A unitized starter construction system for an internal combustion engine, comprising a plurality of sets of modules of different types including a set of modules of a first type each being formed as a drive module having a starter motor and a set of modules of a second type each being formed as a gear module having a reduction gear, at least a set of modules of one type having at least two modules of said one type, said drive module including a first utilized interface embodied as a pinion gear while said gear module including a second unitized interface comprising a receiving area for the pinion gear, so that said drive module and said gear module are operatively connectable with one another by bringing together said first and second interface, and at least one module of another type is operatively connectable with any of the at least two modules of said one type.

2. The unitized starter construction system of claim 1, wherein said sets of modules include at least one electronic module.

3. The unitized starter construction system of claim 1, wherein the at least one gear module includes a planetary gear.

4. The unitized starter construction system of claim 3, wherein a sun wheel of the planetary gear is a slip-on pinion of a drive shaft of the drive module.

5. The unitized starter construction system of claim 1, wherein the at least one gear module includes an integrated free-wheel mechanism.

6. The unitized starter construction system of claim 2, wherein the at least one electronic module is disposed between the at least one drive module and the least one gear module.

* * * * *